US005213718A

United States Patent [19]

Burgess

[11] Patent Number: 5,213,718

[45] Date of Patent: May 25, 1993

[54] AERATOR AND CONVERSION METHODS

[76] Inventor: Harry L. Burgess, 5400 Memorial Dr., #511, Houston, Tex. 77007

[21] Appl. No.: 787,038

[22] Filed: Nov. 4, 1991

Related U.S. Application Data

[63] Continuation-in-part of Ser. No. 641,057, Jan. 14, 1991, abandoned.

[51] Int. Cl.[5] ..... B01F 3/04

[52] U.S. Cl. ..... 261/93; 261/120; 261/121.2; 210/242.2

[58] Field of Search ..... 261/120, 93, 121.2; 210/242.2

[56] References Cited

U.S. PATENT DOCUMENTS

| | | | |
|---|---|---|---|
| 3,017,951 | 1/1962 | Wiley | 261/93 X |
| 3,189,334 | 6/1965 | Bell | 43/57 |
| 3,214,149 | 10/1965 | Budzien | 261/93 X |
| 3,279,763 | 10/1966 | Niewiarowicz . | |
| 3,347,371 | 10/1967 | Verbaere | 209/172 |
| 3,371,789 | 3/1968 | Hense | 119/5 |
| 3,635,342 | 1/1972 | Mourlon et al. | 210/84 |
| 3,756,578 | 9/1973 | McGurk | 261/120 |
| 3,800,462 | 4/1974 | Coyle | 43/57 |
| 3,815,277 | 6/1974 | Murray | 43/56 |
| 3,837,627 | 9/1974 | Sence | 210/242.2 |
| 3,846,516 | 11/1974 | Carlson | 261/120 |
| 3,920,779 | 11/1975 | Abele | 261/93 X |
| 3,940,461 | 2/1976 | Martin et al. | 261/120 |
| 4,003,796 | 1/1977 | Muller et al. | 261/93 X |
| 4,051,204 | 9/1977 | Muller et al. | 261/93 X |
| 4,086,306 | 4/1978 | Yoshinaga | 261/120 |
| 4,096,215 | 6/1978 | Albrecht | 261/119.1 |
| 4,140,737 | 2/1979 | Hauser | 261/120 |
| 4,142,972 | 3/1979 | Nebeker et al. | 210/84 |
| 4,209,724 | 6/1977 | Muller et al. | 261/93 X |
| 4,240,990 | 12/1980 | Inhofer et al. | 261/87 |
| 4,255,360 | 3/1981 | Jeffries | 261/121.2 |
| 4,280,911 | 7/1981 | Durda et al. | 210/629 |
| 4,290,885 | 9/1981 | Kwak | 261/87 |
| 4,297,214 | 10/1981 | Guarnaschelli | 261/87 |
| 4,348,175 | 5/1982 | Roeckel et al. | 261/91 |
| 4,348,288 | 9/1982 | Yoshinaga et al. | 210/708 |
| 4,382,804 | 5/1983 | Mellor | 55/400 |
| 4,409,100 | 10/1983 | Rajendren | 261/93 X |
| 4,437,765 | 3/1984 | Seeger | 261/93 |
| 4,448,685 | 5/1984 | Malina | 261/87 |
| 4,454,077 | 6/1984 | Litz | 261/91 |
| 4,465,645 | 8/1984 | Kaelin | 261/87 |
| 4,620,925 | 11/1986 | Allen | 261/93 X |
| 4,687,585 | 8/1987 | Ramshaw | 210/787 |
| 4,732,682 | 3/1988 | Rymal | 261/93 |
| 4,829,698 | 5/1989 | McDonald | 43/57 |
| 4,853,124 | 8/1989 | Tarada | 210/242.2 |
| 4,917,577 | 4/1990 | Stirling | 261/93 X |
| 4,994,177 | 2/1991 | Bogar, Jr. | 43/56 X |
| 5,009,816 | 4/1991 | Weise et al. | 261/93 |
| 5,021,165 | 6/1991 | Kalnins | 210/703 |

FOREIGN PATENT DOCUMENTS

| | | |
|---|---|---|
| 2823515 | 12/1979 | Fed. Rep. of Germany . |
| 3208025 | 9/1983 | Fed. Rep. of Germany . |
| 688308 | 3/1953 | United Kingdom . |

OTHER PUBLICATIONS

"Mino-Mizer-Live Bait Aerator", HyPark Specialty Co., Inc. Information Booklet, 1988.

*Primary Examiner*—Tim Miles

*Attorney, Agent, or Firm*—Browning, Bushman, Anderson & Brookhart

[57] ABSTRACT

An aerator for gasifying a body of liquid comprising a centrifugal pump having a generally vertical axis. The pump comprises a casing having a generally axial liquid inlet opening generally upwardly, a liquid outlet, and an internal fluid flow space communicating the liquid inlet and the liquid outlet. A centrifugal impeller is rotatably mounted in the space and operative to move fluid into the liquid inlet, through the space, and out the liquid outlet. A motor is operatively associated with the impeller to rotate it. The pump defines a cavitation zone in the fluid flow space adjacent a central portion of the impeller. The pump is adapted to maintain a disposition of its casing with the liquid inlet so opening generally upwardly below the surface of the liquid and capable of taking in both liquid from the body and also taking at least enough gas from an area outside the liquid to the cavitation zone so that the pump would surge if slightly more gas were taken.

14 Claims, 4 Drawing Sheets

AERATOR AND CONVERSION METHODS

CROSS REFERENCE TO RELATED APPLICATION

This is a continuation-in-part of prior co-pending U.S. application Ser. No. 07/641,057, filed Jan. 14, 1991, now abandoned.

BACKGROUND OF THE INVENTION

This invention relates to a device for aerating or otherwise gasifying a body of liquid, e.g. a container in which live fish or other marine animals are to be maintained, a waste treatment pond, or the like. More particularly, this aerator may be used for aerating water in a bait bucket or tank in which live bait such as minnows or shrimp are to be sustained.

When marine life is to be sustained in an aquarium or other container, it is necessary to provide appropriate means for aerating the water in the container if the marine life is to remain viable. For example, it is common practice when fishing, particularly in salt water, to utilize live bait such as minnows, and it is desirable to maintain the minnows in a viable condition over fairly long periods of time while the fishing vessel is away from the dock.

DESCRIPTION OF THE PRIOR ART

Niewiarowicz U.S. Pat. No. 3,279,768 is directed to a portable device for aerating a container, such as a minnow bucket or an aquarium. The aerator of Niewiarowicz comprises a submersible aerator including a housing in which an electric motor is mounted, a circular rotor casing mounted to the bottom of the motor housing, a drive shaft extending into the rotor casing and having a rotor in the form of an axial flow propeller mounted thereon. An air tube is provided for introducing air into the interior of the motor housing, and radial ports are provided in the bushing for the drive shaft in order to permit the air introduced into the motor housing to flow into the rotor casing for use in aerating water. A suitable means such as a suction cup is fixed to the side of the motor housing so that the device can be fixed in the aquarium.

Coyle U.S. Pat. No. 3,800,462 is directed to a water aerator comprising a submersible battery operated bilge pump located within a water container mounted to the side of the boat. Water is drawn into the bilge pump and pumped through a water tube to a tubular arrangement located in the tank above the water level, the tubular arrangement being provided with openings through which water pumped thereto through the water tube is sprayed so as to be aerated as it falls back into the water tank.

Murray U.S. Pat. No. 3,815,277 is directed to an aerated bait container having a pump, such as a bilge pump, mounted at the side thereof. Water drawn into the pump is discharged through a U-shaped tube having a perforated horizontal component so that water pumped into the U-shaped tube will be sprayed through air to flow back into the bait container as the water is pumped around the U-shaped tube and back into the water tank.

Jeffries U.S. Pat. No. 4,255,360 is directed to a water aerator comprising a pump mounted at the bottom of a tank, the pump being provided with an outlet tube extending above the surface of the water in the tank so that water pumped into the tube will be discharged as a spray above the level of water in the tank in order to aerate the water that is sprayed from the container.

McDonald U.S. Pat. No. 4,829,698 is directed to an aerated bait tank which comprises a circular storage chamber surrounding an aerator. The height of the aerator is less than the height of the storage chamber and the operating level of water in the storage chamber is above the top of the aerator so that water flows over the top of the aerator and is aerated as it cascades to the bottom of the aerator. A pump in the bottom of the aerator returns the aerated water to the storage chamber tangentially to induce and maintain a circular path of flow for the aerated water.

U.S. Pat. No. 4,297,214 to Guarnaschelli discloses an aerator specially designed for aeration of liquid waste in activated sludge plants. A centrifugal impeller is rotatably driven by a hollow shaft through which air can pass into the impeller proper through lateral holes in that shaft at the level of the impeller. The impeller has a separate submerged liquid inlet concentrically surrounding the hollow drive shaft. The hollow drive shaft extends all the way to the bottom plate of the impeller.

British Patent No. 688,308 discloses a device for agitating and/or aerating liquids such as milk. A hollow rotary shaft communicates directly with the interiors of a number of hollow radial blades. Movable sleeves surrounding the hollow shaft can be used to cover or uncover various sets of lateral ports, at different levels with respect to the liquid, so as to allow liquid and/or air to pass into the interior of the shaft and thence through the blades, as desired.

Buoyant aerators and buoyant pumps, which can float in a body of water, have also been known. A buoyant centrifugal pump is sold under the trademark "WaterBuster" by Attwood Subsidiary Steelcase Inc. of Lowell, Mich. A floating aerator is sold under the trademark "Mino-Mizer" by Hy Park Specialty Co., Inc., of Minnetonka, Minn.

Known aerators, such as those described above, have all suffered from some type of disadvantage. Some do not aerate the water as well as might be desired. Others are unduly complicated. Some operate by spraying water up into the air, so that it falls back down into the body of water; this is not only not the best way of aerating the water, but can also be messy and undesirable for certain applications.

Another problem is clogging by debris in the water, and this can be a particular problem if the aerator is being used with bait shrimp. The small, filament-like feelers and legs of the shrimp tend to become detached and can clog conventional aerators. Devices such as those shown in U.S. Pat. No. 4,297,214 and British Patent No. 688,308 have the further problem of a rotary shaft extending upwardly from the impeller through the liquid. Shrimp feelers and legs and other debris tend to move toward the axis, wind around the rotary shaft, and exacerbate fouling and clogging problems.

Another need in the art of aerators, particularly those comprising pumps, is for prolonged operating time from a given battery.

SUMMARY OF THE INVENTION

The aerator of the present invention is based on the rather surprising discovery that, in order to serve as an improved aerator, a centrifugal pump should be modified so that it draws into its cavitation zone a quantity of air which is ordinarily considered undesirable in the running of a centrifugal pump, and is usually avoided.

In order not only to allow, but to positively cause this, the pump is adapted to maintain a disposition of the pump casing with the liquid inlet opening upwardly and capable of taking in liquid from a body of liquid in which the pump is disposed and also take a substantial amount of air or other gas from an area above that body of liquid to the pump's cavitation zone. Preferably, the pump thus takes in so much air that it surges, or is on the verge of surging.

"Aerator" is used herein in a broad sense to describe a device for introducing air or any other gas into water or any other liquid. Since a typical application is in introducing air into water in a live bait container, the remainder of this description will frequently refer to air and water for convenience, without limiting the scope of the invention.

In preferred embodiments, the pump comprises a water impermeable motor casing in which a motor is mounted. A drive shaft operably connected with the motor extends through the top of the motor casing and a hubbed vaned centrifugal rotary impeller is mounted on the drive shaft above the motor. Water flow directing means, such as an impeller housing, encases the impeller, the water flow directing means being provided with a water inlet, above the impeller and opening upwardly, and a water outlet, preferable below the inlet and opening laterally, so that rotation of the impeller will cause water to flow down into the water flow directing means through the water inlet, through the vaned impeller and laterally out of the water flow directing means through the water outlet. With this construction, a cavitation eye will form in a cavitation zone at the top of the impeller when the impeller is rotated by the motor.

In one version of the invention, an air inlet tube is mounted on the aerator and extends through the flow directing means, the air inlet tube having an upper inlet end outside the water for the introduction of air into the tube and a lower end terminating in the cavitation zone that is formed when the impeller is rotated. As a consequence, when the centrifugal pump rotates, the vacuum formed in the cavitation zone by rotation of the impeller will draw air through the air tube into the cavitation eye where a portion of the air will be entrained in the water flowing through the vaned impeller and out the water flow directing means into the tank. Excess air drawn into the cavitation eye through the air inlet tube can escape upwardly through the water inlet thereby preventing air locking of the impeller, as will typically occur if air accumulates in the cavitation zone of a centrifugal pump mounted in the "normal" pump operating position, with the water inlet opening downwardly.

In at least some preferred embodiments of this first version of the invention, the tube is stationary and completely distinct and independent from the drive shaft. It is also preferably eccentrically offset from the central axis of the impeller.

In another version of the invention, no special air conduit or tube is provided, but the pump is adapted to float in the water in an operating position with the inlet opening upwardly and disposed, with respect to the surface of the body of water, so that both water from that body and air from the area above the body are drawn into the water inlet, and thus into the cavitation zone, by virtue of the vacuum created upon rotation of the impeller. In other words, the pump floats with the inlet disposed a relatively short distance below the surface of the water when the pump is not operating. When the pump is operating, a vortex is created in the water just above the inlet, and this also causes a concavity in the surface of the water, and air is drawn into the concavity, entrained with the water in the vortex and thus drawn through the pump. The results can be optimized by empirically optimizing the distance of the inlet from the surface of the water for the particular pump being used.

In preferred embodiments of this latter version of the invention, the pump is ballasted, to set its center of gravity such that, if the pump is placed in the water other than in its operating position, it will automatically turn to its operating position. Also in preferred forms, an enclosure extends upwardly around the inlet to a level above the surface of the water, and a strainer is incorporated in this upstanding enclosure. Although the aerator, even without this strainer, does not tend to clog with small debris such as shrimp legs, the strainer prevents, for example, whole shrimp from being drawn into the impeller and killed. A floatation collar may also form part of this upstanding enclosure.

In all of these embodiments of the invention, the pumping of a combination of air and water not only serves to aerate the water, but by introducing air into the water below the surface, this aeration is more effective than in systems wherein water is sprayed upwardly and cascades down into the body entraining air with it. Furthermore, the pumping of a combination of air and water so reduces the demands on the motor, that the device can operate for a very long time on a single battery or charge. Also, the invention is uncomplicated; it can be made by performing relatively simple modifications to a conventional centrifugal pump, and is thus relatively economical and trouble-free in operation.

BRIEF DESCRIPTION OF THE DRAWINGS

In the accompanying drawings.

DESCRIPTION OF THE PREFERRED EMBODIMENTS

Figure 1:
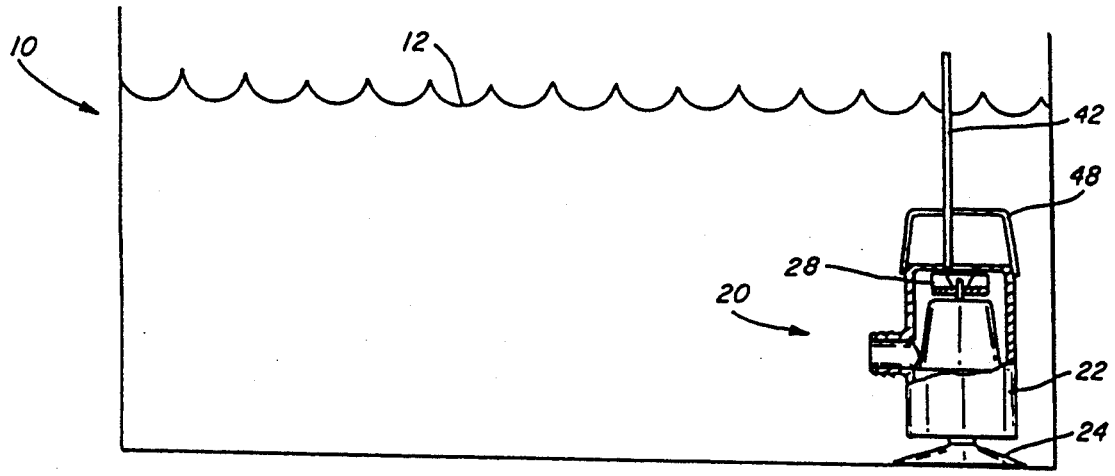
FIG. 1 is a side elevational sectional view illustrating a first embodiment of the aerator of the present invention mounted in an appropriate water container.
Figure 2:
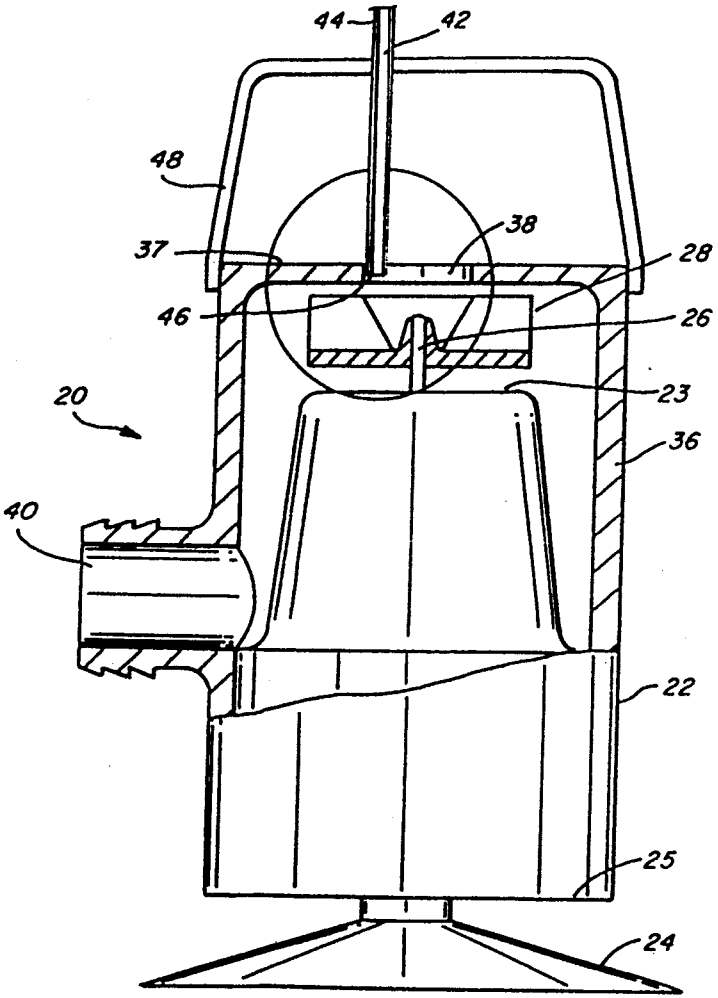
FIG. 2 is a side elevational view, with parts broken away, to an enlarged scale, of the aerator of FIG. 1.

Referring now to the drawings, and first to FIG. 1, there is shown a tank 10 containing water 11 at a level 12. Tank 10 diagramically represents any suitable container, such an aquarium in which pet fish are kept, an ice chest in which live bait are taken while fishing, or any other suitable container. It will also be readily appreciated that the invention can be used to aerate or gasify any body of liquid, whether in a relatively small container such as that shown, or larger, e.g. a waste treatment pond, either man-made or natural. An aerator 20 of the present invention is mounted in the bottom of the tank. With reference to FIGS. 1 and 2, the aerator 20 comprises a water impermeable motor casing 22 having a flat top 23 and a flat bottom 25. Suitable retaining means are provided, such as a suction cup 24 mounted to the flat bottom of the motor casing, in order that the aerator may be fixed to the bottom of the tank 10.

An electric motor (not shown) of any conventional construction is mounted inside the motor casing 22 and is provided with a drive shaft 26 extending through the top of the motor casing. A centrifugal rotary impeller 28 comprising a bottom impeller plate 30 having a centrally located hub 32 is provided, the hub 32 being fixed to the top of the drive shaft 26. The impeller 28 is provided with a plurality of impeller vanes 34.

Figure 4:
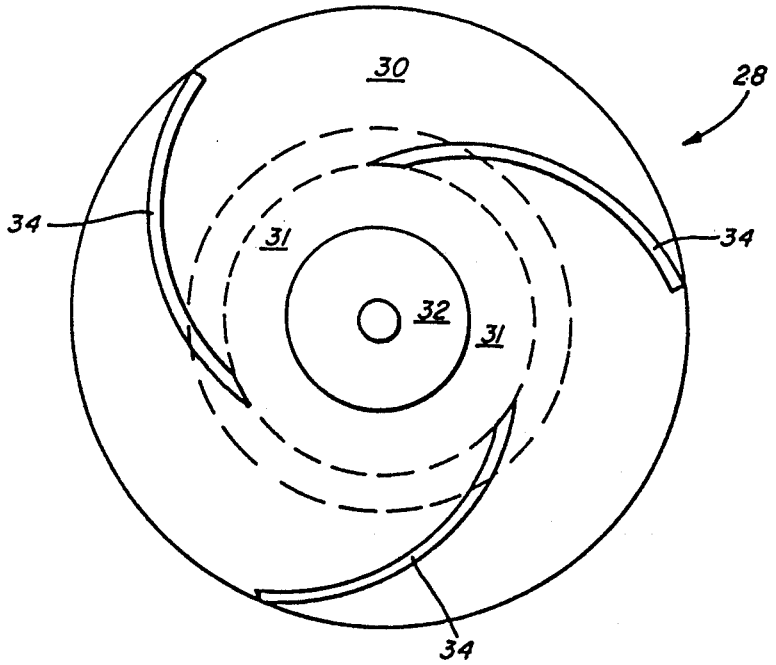
FIG. 4 is a top plan view showing the preferred construction of the centrifugal impeller used in the practice of the present invention and also showing the location of the cavitation zone.
Figure 3:
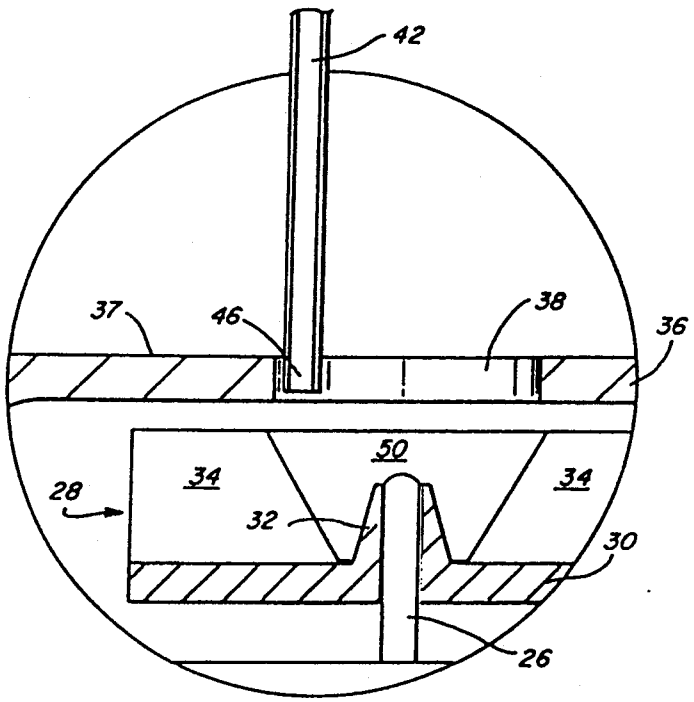
FIG. 3 is a sectional view, to a still further enlarged scale, of a portion of the aerator of FIGS. 1 and 2.

As is shown more clearly in FIG. 4, the impeller vanes 34 are mounted on the top of the circular impeller plate 30 of the centrifugal impeller 28 mounted on the drive shaft 26 by means of the hub 32. The location of the cavitation zone 31 is indicated by the dotted lines.

An impeller casing or water flow directing means 36 provided with a flat top 37 is connected to or formed integrally with the motor casing 22. The impeller casing 36 extends upwardly past the top 23 of motor casing 22 and is shaped so as to encompass the impeller 28. The impeller casing 36 is provided with an inlet opening 38 on the flat top thereof above the impeller 28. A lateral water outlet line 40 is provided in the impeller casing below the impeller for delivering water drawn into the impeller casing through the inlet opening 38 back into the tank in order to circulate the aerated water.

Preferably, a strainer 48 of any suitable construction is mounted to the top of the impeller casing 36 and an air tube 42 is provided. As shown, tube 42 is rigid, having an upper or air inlet end extending above the normal level 12 of water 11 in the tank 10 and a lower outlet 46 extending into the inlet opening 38 of the impeller casing 36 and into the cavitation zone 31. However, tube 42 could be flexible, secured to the side of tank 10, or allowed to hang over the edge of the tank 10, so long as its air inlet end is outside water 11. Tube 42 may be fixed to casing 36 in any suitable manner.

Suitable means such as a battery (not shown) are provided for delivering electricity to the electric motor mounted inside the motor casing 22.

The electric motor (not shown) within the motor casing 22 may be of any suitable construction being, for example, the type incorporated in a Rule 450 GPH bilge pump.

It can be seen that the tube 42 is much smaller than inlet 38, and is laterally offset from the center of inlet 38, so that it does not unduly interfere with the normal flow of water or obstruct the inlet. As has previously been mentioned, any excess air tending to accumulate in the eye of the impeller will not become trapped and air lock the pump, but rather is free to bubble upwardly through the upwardly opening inlet 38, and escape through the surface of the water. This can occur intermittently, thus causing surging, i.e. intermittent running of the pump. However, by proper sizing of the tube 42, which can be empirically determined, for the parameters of the particular pump being used, an optimized amount of air can be caused to flow into the eye of the impeller, so that the pump will run continuously just below the surge point. However, it is preferable that the air quantity not be reduced very far below the surge point. The pump preferably takes in at least enough air so that it either does surge or would surge if slightly more air were taken, i.e. so that if slightly more air were taken, the pump would surge in any event (keep surging or begin to surge).

The pumping of both air and water, and its discharge well below the surface 12 of the water, provides excellent aeration. In addition, the reduced demands on the motor when the pump is handling a large quantity of air allow the device to operate for a long time on a given battery or charge, and also makes for a longer life of the motor itself.

In the operation of the aerator of FIGS. 1–4, the aerator is mounted in the water tank 10 below the normal level 12 of water in the tank and in an inverted position from that in which such a pump is normally mounted. That is to say, the motor casing 22 is mounted so that the drive shaft and the impeller extend above the electric motor rather than extending below the motor as is usually the case, and the inlet 38 opens upwardly as shown. When the electric motor is energized, drive shaft 26 rotates causing corresponding rotation of the impeller 28 whereby water is drawn into the inlet opening 38, through the impeller vanes, and laterally discharged by the impeller vanes 34 to the water outlet 40.

The circular motion imparted to the water inside the impeller casing 36 will cause a cavitation eye 50 to form about the hub 32 in the cavitation zone 31. Air will be drawn through the air inlet 44 through the air tube 42 and out the lower outlet 46 into the cavitation eye 50. At least a portion of the air will be entrained into the water flowing through the impeller vanes 34 and thence through the outlet opening 40 back into the tank, thus providing for circulation of and aeration of the water in the tank. Excess air drawn into the cavitation eye can escape through the upwardly opening inlet 38 to thereby prevent air locking of the rotary impeller 28.

It should thus be understood that, although inlet 38 may, for convenience, be called the "water inlet" or "liquid inlet," air or other gas from the area above the liquid surface 12 enters inlet 38 via tube 42, and excess air also escapes outwardly through "inlet" 38.

It is important that the motor and the impeller casing be mounted in the fish tank with the impeller casing and the impeller above the motor so that inlet 38 faces generally up. When a pump otherwise identical to the aerator 20 was provided with a modified air tube so that it could be mounted in a bait tank in the "normal" position with the strainer 48 adjacent the bottom of the tank, air drawn into the inside of the impeller casing through the modified air tube remained in the vortex eye and caused the impeller to air lock.

In like fashion, when such a pump was mounted in a bait tank in a lateral position with the strainer, motor casing and impeller casing axially laterally aligned, the air drawn into the impeller again caused air locking of the pump. The degree to which the centerline of the inlet could deviate from true vertical without air locking can be empirically determined for each given pump design. Angles within that range will be considered "generally upward" as well as "generally vertical" or "axial" in the sense of this specification for the particular pump in question and will, in all cases, be significantly less than 90°.

As is well known is the art of centrifugal pumps, when the net positive suction head ("NPSH") available is less than that required under any particular condition of operation, cavitation will occur. The orientation of the pump in accord with the present invention, and the introduction of air into the eye of the impeller reduces the head. Over and above the active introduction of air from above the body of water into the eye of the impeller, as described above, some true cavitation may also occur. Within reasonable limits, this is not undesirable, as would normally be the case, but surprisingly, may enhance the aeration capabilities of the device.

In one rather surprising experiment, an embodiment of the invention similar to that shown in FIGS. 1 through 4 was run continuously almost every weekend over about a two year period before any failure occurred. The failure which did occur after about two years was caused by corrosion in the tube 44, which eventually blocked the air path, but not due to any actual pump failure. This length of performance stands in stark contrast to the typical life of a conventional aerator. It was therefore concluded that any slight damage which might be accumulating due to any actual cavitation occurring was far outweighed by the reduced horsepower requirements brought about by virtue of the large relative quantity of air being handled by the pump.

Figure 5:
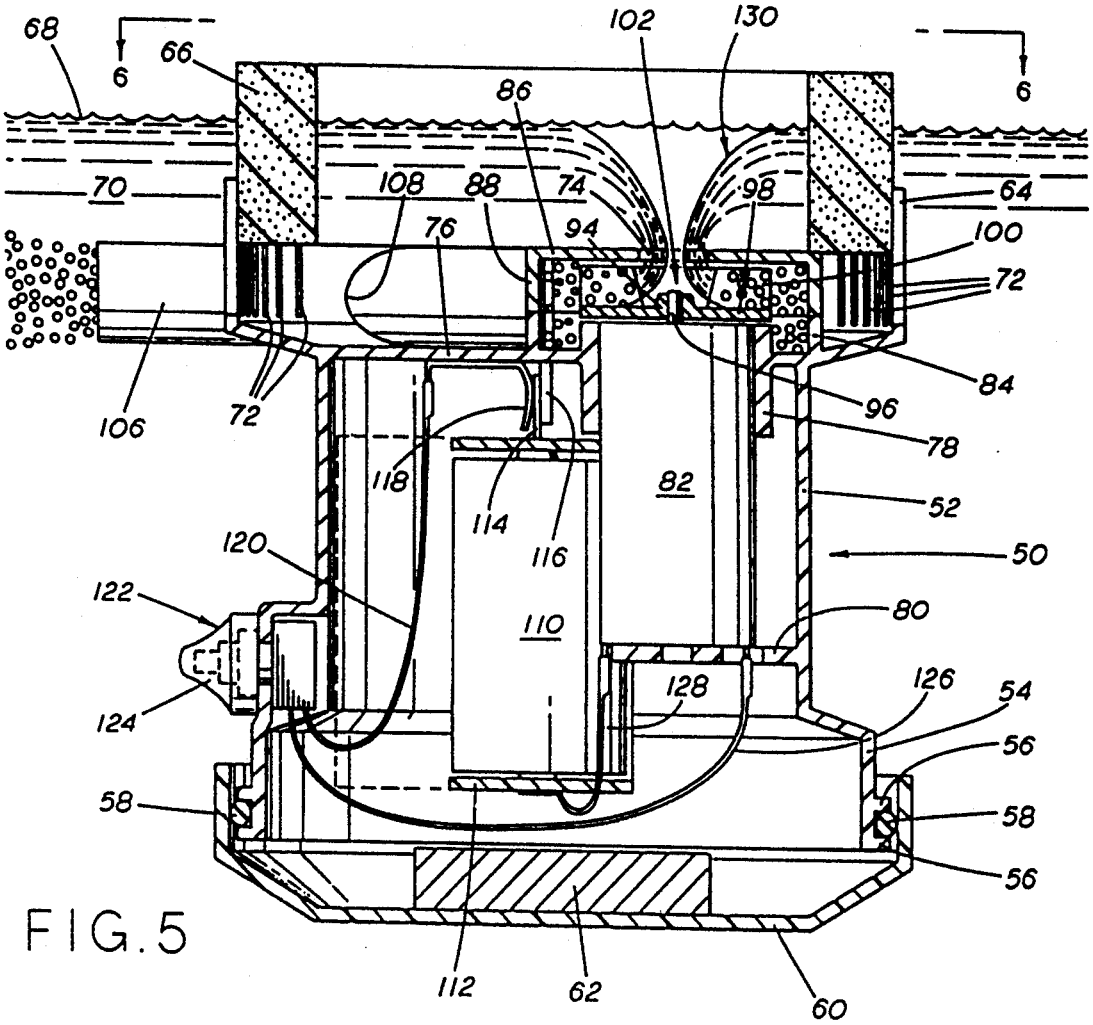
FIG. 5 is a longitudinal cross-sectional view of a second embodiment of aerator according to the present invention.

Referring now to FIGS. 5 et. seq., there is shown a second embodiment of the invention. This embodiment incorporates many of the advantages and features of the other embodiment, but eliminates the need for a special tube 42, by utilizing a buoyant pump and causing it to float with its water inlet spaced a short distance below the level of the water, so that air can be drawn into the vortex created by the impeller, from the area above the body of water, without the use of a special air tube.

Referring now more particularly to FIGS. 5 et. seq., there is shown an otherwise conventional, buoyant, submersible, centrifugal pump, such as an Attwood "WaterBuster" pump, which has been modified for use as an aerator 50 according to the present invention. The device 50 includes a housing including a generally cylindrical main body portion 52 molded of a suitable synthetic material, and enlarged at its upper and lower ends as shown. The enlarged lower end forms a downwardly depending skirt 54 on the outer side of which are formed parallel annular flanges 56 between which is mounted an O-ring type seal 58. A cover 60, separately formed of a similar synthetic material, is removably fitted over the outer portion of skirt 54, being sized to sealingly engage the O-ring 58. Cover 60 may be releasably held on skirt 54 by any well known means, such as bayonet-type connections (not shown).

In modifying a pump for use as aerator 50, a ballast weight 62 is fixed in the lower end of the pump, as by gluing or bolting to cover 60, as shown. It is to be understood that the conversion of a conventional pump into the aerator 50 may also involve the removal of other weighted parts, e.g. a plate which might extend across the skirt 64 at the opposite enlarged end of housing 52. In the event that, instead of converting a conventional pump for this use, a pump is custom made for this unique aerator use, it may be unnecessary to add or subtract weighted members, but rather, the relative positions and shapes of the essential working parts of the pump can be designed and arranged to provide the desired effect, which is to locate the center of gravity such that, if the pump is simply dropped into a body of liquid at random, and lands in any position other than the operating position shown in FIG. 5, it will automatically turn itself to the operating position. As mentioned, in the embodiment shown, weight may be removed from the end which is desired to be uppermost in the aerator operating position, and weight 62 may be added to the lower end.

As previously mentioned, the upper end of housing 52 is likewise enlarged, and includes an annular skirt 64. A buoyant cylinder 66 of foam or the like is fitted coaxially within the outer or upper end of skirt 64 so that, together, skirt 64 and cylinder 66 form an enclosure the length of which ensures that the enclosure will extend above the surface 68 of the liquid 70 in which the aerator 50 is floating and operating. The primary reason for this is that skirt 64 is provided with slits 72 so that it serves as a strainer, to allow liquid 70 to enter the enclosure 64, 66, but keep out the shrimp or other bait. To prevent such bait from passing over the upper edge of the enclosure, it should be ensured that that enclosure extends above the surface 68 of the liquid. As will be described more fully below, the aerator 50 should float in the liquid 70 with its inlet 74 below the surface 68, so that it takes in water, but close enough to the surface 68 so that it will also take in air. In the embodiment shown, cylinder 66 is buoyant, and thus serves as a floatation collar to help the aerator 50 float in a proper operating position. In addition, since, when the aerator 50 floats at the optimum distance from the surface 68, skirt 64 does not extend above that surface, floatation collar 66 in the embodiment shown is also sized to extend the height of the enclosure which it forms jointly with skirt 64.

It will be appreciated that, depending upon the details of the pump which is modified for aerator use, the inherent buoyancy of the pump, particularly with proper adjustment of the ballast, may be such that no additional floatation collar is needed. In that case, the foam cylinder 66 could be replaced by a simpler and thinner extension of the skirt 64. On the other hand, if the skirt 64 is of adequate height without extension, any additional flotation device(s) which may be added would not need to extend above the edge of the skirt, and indeed would not need to be annular, nor even attached to the skirt 64, but could be located elsewhere about the device 50. Of course, it is possible that some pumps might not need any modification in this regard, that is to say, they might float at the proper level, with their skirts 64 extending above the surface 68, without any skirt extension or additional floatation device. This could be particularly designed into any pump which is custom made for aerator purposes, rather than modified.

Also, in some embodiments, the skirt and strainer may be omitted, since the pump tends not to clog when run "inlet up."

Integral with the generally cylindrical outer wall 52 of the main body portion of the housing are several internal walls. A transverse wall 76 extends generally across the housing, at the juncture between the smaller diameter central portion 52 and the enlarged upper portion which includes skirt 64. At one side, lateral wall 76 has an opening surrounded by an upstanding cylinder 78 formed integrally with wall 76 and extending both above and below that wall. Cylinder 78 receives the upper end of the electric motor 82, which is supported on an internal shelf 80. For simplicity, shelf 80 is shown as being formed integrally with housing part 52. However, as is well known in the art, either shelf 80 or at least a part of cylinder 78 would be separately formed, and affixed to the remainder of the housing, e.g. by screws, in order to allow assembly of the motor 82 into the pump.

An annular rim 84, also integrally formed with parts 52 and 76, extends upwardly from wall 76 in surrounding relation to the upper part of cylinder 78. Along with the enclosed portion of wall 76, and the upper part of cylinder 78, rim 84 forms the lower portion of the impeller casing which is encompassed in the overall housing structure. The upper end of the motor 82 completes this by closing or filling the opening formed within cylinder 78.

The upper half of the impeller casing is formed by a separate member including a horizontal plate 86, having a central aperture 74 which serves as the liquid inlet, and a downwardly depending annular rim 88 sized to match with rim 84. Integrally formed about the peripheries of the two rims 88 and 84 are respective aligned ears 90 and 92 (FIG. 7) which are internally threaded to receive screws 94 for securing the two halves of the impeller casing together. It is noted that the upper surface of the top half of the impeller casing 86, 88 serves as a stop for floatation collar 66, so that it cannot slip all the way down into skirt 64 thereby blocking off the strainer slits 72. Even if floatation collar 66 is glued or otherwise positively affixed on skirt 64, rather than simply friction fitted therein, it is helpful to have such a stop surface to properly position the collar 66 when it is being fixed in place.

As in the preceding embodiment, the impeller housed in casing 84, 86, 88 includes a hub 94 fixed to a rotary shaft 96 which protrudes upwardly from the motor 82 and is rotated thereby. The bottom plate 98 of the impeller is formed integrally with and extends radially outwardly from the hub 94. Blades 100 spiral outwardly from a void eye 102, in upstanding relation to plate 98.

Figure 7:
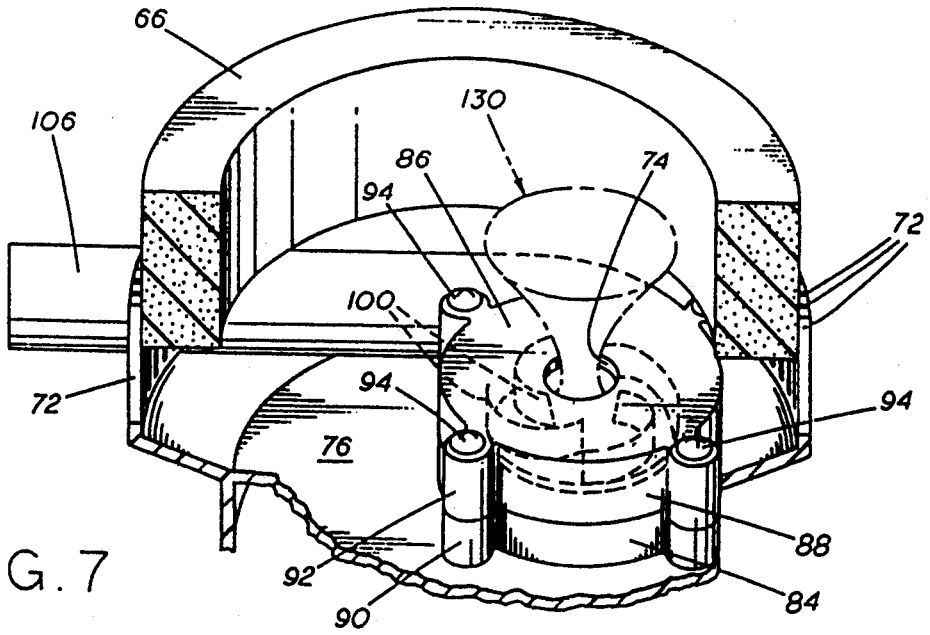
FIG. 7 is a partial perspective view of the embodiment of FIG. 1.
Figure 6:
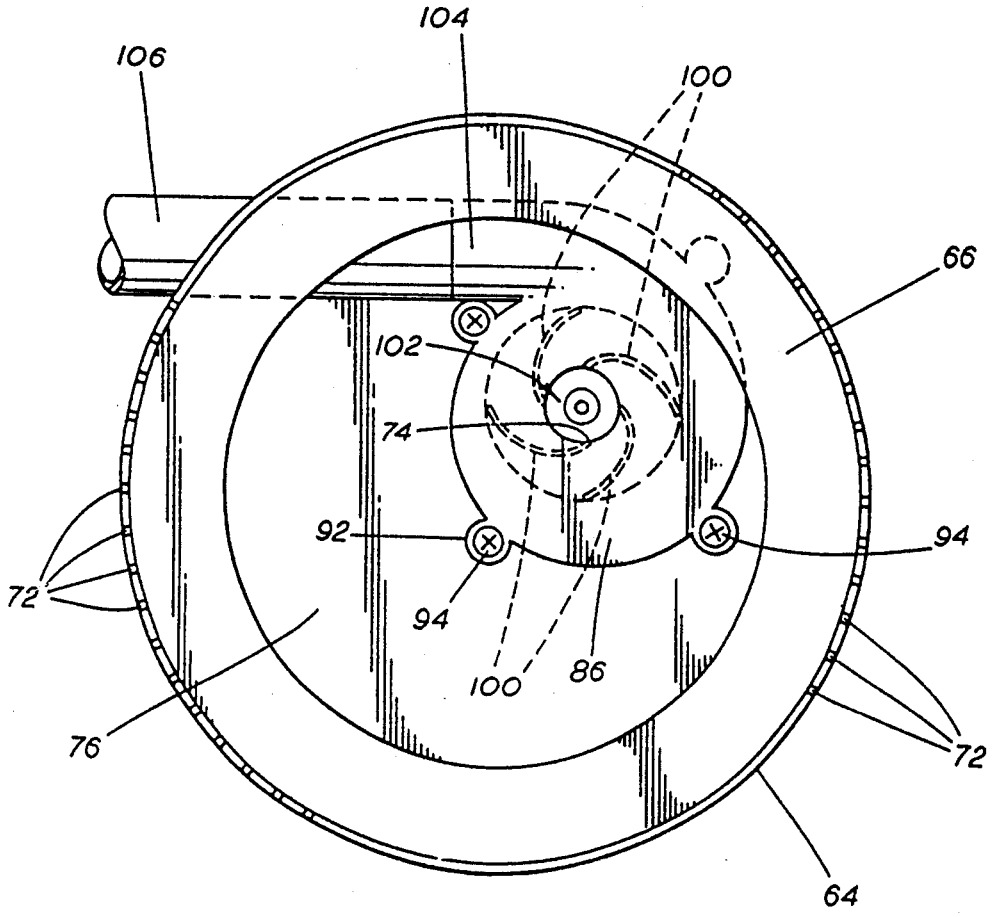
FIG. 6 is a top plan view taken on the line 6—6 of FIG. 5.

As previously mentioned, the aperture 74 in plate 86 forms the liquid inlet of the impeller casing, which is centered over the eye 102 of the impeller. As best seen in FIGS. 6 and 7, the impeller casing has a lateral, more specifically tangential, liquid outlet formed by opposed, aligned extensions of the upper and lower portions of the impeller casing, the extension of the upper part 86, 88 of the impeller casing being shown at 104. A piece of flexible tubing 106 is fitted into the outlet 104, and extends out through an opening 108 in the housing so that the aerated liquid is discharged well into the body of liquid 70.

Below wall 76, and to the side of the formations 78, 80 which hold the motor 82, there is a space for receipt of a battery pack, which may include several batteries 110 snapped into the contacts carried by a bracket-like holder 112. In a well known manner, the bracket 112 and/or batteries held therein are configured to cooperate with interior surfaces of the housing to properly position the battery pack therein. When properly positioned, electrical connectors such as that shown at 114 are clamped between braces 116, formed integrally with the housing, and contacts 118. The particular contact 118 shown is connected by wire 120 with the switch mechanism 122, which in turn is protected from the liquid by an elastomeric cover 124. Switch 122 is also connected by wire 126 to motor 82 through an aperture in support 80, and motor 82 is connected with the batteries 110, as by wire 128, all as well known in the art, and therefore simplified herein.

When the impeller 94, 98, 100 is rotated by motor 82, a vortex 130 is created in the liquid within enclosure 64, 66. This draws that liquid down into inlet 74 and the eye 102 of the impeller, whence it is accelerated and propelled laterally outwardly between the impeller blades 100 and out through outlet 104 and tubing 106. The vortex 130 may be considered to create a concavity in the surface 68 of the water and/or a gas space in the center of the vortex. If the aerator 50 floats close enough to the surface 68, this gas space will extend all the way down into the eye 102 of the impeller as shown. However the aerator 50 should not float so high that the diameter of the air space matches that of inlet 74. In other words, the casing has a disposition such that the inlet 74, being below the surface of the liquid, can take in liquid from the body in which it is floating, but can also take in gas from the area above the surface 68, directly through the vortex it creates, and without the need for an auxiliary tube such as 42 in the embodiment of FIGS. 1–4. The optimum distance, so that some air is taken into the eye of the impeller, but not too much, can be empirically determined for a given pump design.

In the eye 102 of the impeller, at least a portion of the air or gas drawn into the eye of the impeller is there mixed and/or entrained with the water, also sucked into the eye of the impeller, so that the water is aerated as it passes through the outlet 104, 106. As in the preceding embodiment, any excess air tending to build up in the eye of the impeller, and which might otherwise indefinitely air lock the pump, can, because of the upwardly facing orientation of the inlet 74, simply escape upwardly through the liquid 70 and back into the air space thereabove.

Because the aerator floats in an operating position which properly spaces the inlet 74 from surface 68, it is unnecessary to mount the aerator at a given level nor to maintain any particular liquid level in the tank.

Having thus described my invention, what is claimed is:

1. An aerator for gasification of a body of liquid comprising:

a centrifugal pump having a generally vertical axis and comprising a casing having a generally axial liquid inlet opening generally upwardly with an open space above said inlet, a liquid outlet, and an internal fluid flow space communicating said liquid inlet and said liquid outlet;

a centrifugal impeller rotatably mounted in said space and operative to move fluid into said liquid inlet, through said space, and out said liquid outlet; and drive means operatively associated with said impeller to rotate said impeller;

said pump defining a cavitation zone in said space adjacent a central portion of said impeller;

and float means positioning said pump so as to maintain an operating disposition of said casing with said liquid inlet so opening generally upwardly below the surface of said liquid and capable of taking in liquid from said body and also taking at least enough gas from an area outside said body to said cavitation zone so that the pump would surge if slightly more gas were taken.

2. The device of claim 1 wherein said pump is buoyant and is adapted to maintain said disposition by floating in said disposition with respect to the surface of the liquid;

and wherein said pump has a center of gravity located such that, if the pump is placed in the body of liquid not in said operating disposition, the pump will turn to said operating position.

3. An aerator for gasification of a body of liquid comprising:

a centrifugal pump having a generally vertical axis and comprising a casing having a generally axial liquid inlet opening generally upwardly, a lateral liquid outlet, and an internal fluid flow space communicating said liquid inlet and said liquid outlet, said casing defining an unobstructed open space above said liquid inlet, substantially wider than said liquid inlet, and open upwardly;

a centrifugal impeller rotatably mounted in said space closely adjacent said liquid inlet and operative to move fluid into said liquid inlet, through said space, and out said liquid outlet; and drive means operatively associated with said impeller to rotate said impeller;

said pump defining a cavitation zone in said space adjacent a central portion of said impeller;

and float means to position said pump in said liquid in an operating position with said liquid inlet so opening generally upwardly and disposed, with respect to the surface of the body of liquid, so that gas from above said body is drawn directly into said liquid inlet and thence to said cavitation zone upon rotation of said impeller, and liquid from said body is also drawn into said liquid inlet, said float means being adapted to maintain said liquid inlet at a position where it takes in at least enough gas so that the pump would surge if slightly more gas were taken in.

4. The device of claim 3 wherein said pump is so adapted that, in said operating position, said liquid inlet is disposed a short distance below the surface of the liquid.

5. The device of claim 4 comprising a strainer interposed between said liquid inlet and the body of liquid.

6. The device of claim 3 wherein said pump has a center of gravity located such that, if the pump is placed in the body of liquid not in said operating position, the pump will turn to said operating position.

7. The device of claim 6 wherein said center of gravity is established by ballast carried by said pump.

8. A method of converting a centrifugal pump for use as an aerator, comprising the steps of:

associating buoyant means with said pump, and adapting said buoyant means so that said pump can float in a body of liquid in an operating position with an axis thereof generally vertical, an unobstructed liquid inlet thereof opening generally upwardly, and said liquid inlet disposed below the surface of the liquid by a distance such that, upon operation of the pump, at least enough gas from an area above the body will be drawn into a cavitation zone of the pump so that the pump would surge if slightly more gas were taken, but liquid from the body is also taken into the cavitation zone.

9. The method of claim 8 further comprising the step of ballasting the pump so that, if the pump is placed in a body of liquid not in said operating position, the pump will turn to the operating position.

10. The method of claim 8 including so ballasting the pump so that said distance from the surface of the liquid is such that at least enough gas is so taken to said cavitation zone that the pump would surge if slightly more gas were so taken.

11. An aerator for gasification of a body of liquid comprising:

a centrifugal pump having a generally vertical axis and comprising a casing having a generally axial liquid inlet opening generally upwardly, a liquid outlet, an internal fluid flow space communicating said liquid inlet and said liquid outlet;

an enclosure upstanding from said casing in surrounding relation to said inlet, a strainer being incorporated in said enclosure;

a centrifugal impeller rotatably mounted in said space closely adjacent said liquid inlet and operative to move fluid into said liquid inlet, through said space, and out said liquid outlet; and drive means operatively associated with said impeller to rotate said impeller;

said pump defining a cavitation zone in said space adjacent a central portion of said impeller;

and said pump being adapted to float in said liquid in an operating position with said liquid inlet so opening generally upwardly and disposed, with respect to the surface of the body of liquid, so that gas from above said body is drawn directly into said liquid inlet and thence to said cavitation zone upon rotation of said impeller, and liquid from said body is also drawn into said liquid inlet, and an upper edge of said enclosure is above the surface of the liquid.

12. The device of claim 11 wherein said enclosure comprises a skirt, having said strainer incorporated therein, and a flotation collar mounted generally coaxially with said skirt.

13. The device of claim 12 wherein said flotation collar extends upwardly past the upper extremity of said skirt, the upper extremity of said skirt being disposed approximately at or below the surface of the liquid when the pump is in said operating position.

14. The device of claim 13 further comprising ballast carried by said pump and so located that, if the pump is placed in the body of liquid not in said operating position, the pump will turn to said operating position.

* * * * *